US010145083B2

(12) United States Patent
Knol

(10) Patent No.: US 10,145,083 B2
(45) Date of Patent: Dec. 4, 2018

(54) SPUD CARRIER SYSTEM

(71) Applicant: IHC Holland IE B.V., Sliedrecht (NL)

(72) Inventor: Albertus Knol, Numansdorp (NL)

(73) Assignee: IHC Holland IE B.V., Sliedrecht (NL)

( * ) Notice: Subject to any disclaimer, the term of this patent is extended or adjusted under 35 U.S.C. 154(b) by 210 days.

(21) Appl. No.: 15/311,196

(22) PCT Filed: May 13, 2015

(86) PCT No.: PCT/NL2015/050339
§ 371 (c)(1),
(2) Date: Nov. 15, 2016

(87) PCT Pub. No.: WO2015/174838
PCT Pub. Date: Nov. 19, 2015

(65) Prior Publication Data

US 2017/0089037 A1 Mar. 30, 2017

(30) Foreign Application Priority Data

May 16, 2014 (NL) ..... 2012825

(51) Int. Cl.
*E02F 9/06* (2006.01)
*B63H 19/08* (2006.01)
*E02F 9/22* (2006.01)

(52) U.S. Cl.
CPC ..... *E02F 9/062* (2013.01); *B63H 19/08* (2013.01); *E02F 9/2217* (2013.01)

(58) Field of Classification Search
CPC ..... E02F 9/062; E02F 9/2217; B63H 19/08
See application file for complete search history.

(56) References Cited

U.S. PATENT DOCUMENTS 890,470 A * 6/1908 Taft et al. ..... B41J 2/325 346/111
3,003,454 A * 10/1961 Shatoska ..... E02F 9/062 37/346
3,656,449 A * 4/1972 Mead ..... E02F 9/062 37/346
4,033,056 A * 7/1977 Demmers ..... E02F 9/062 37/309
4,342,164 A * 8/1982 Claassen ..... E02F 3/907 37/309

(Continued)

FOREIGN PATENT DOCUMENTS

EP 0227143 A1 7/1987
JP 01226939 A * 9/1989 ..... E02F 3/8841

(Continued)

*Primary Examiner* — Jamie L McGowan
(74) *Attorney, Agent, or Firm* — N.V. Nederalndsch Octrooibureau; Catherine A. Shultz; Tamara C. Stegmann

(57) ABSTRACT

The invention relates to a spud system for a dredging vessel with a longitudinal direction, which spud system comprises;

a spud carrier for mounting a spud therein in a vertical stance and which spud carrier is mounted for limited rotation around a horizontal transverse axis and is moveable with respect to the dredging vessel in a longitudinal direction for advancing the dredging vessel, and a spud carrier drive system coupled with the dredging vessel and the spud carrier for driving the spud carrier with respect to the dredging vessel.

14 Claims, 6 Drawing Sheets

(56) References Cited

U.S. PATENT DOCUMENTS

| | | | | | |
|---|---|---|---|---|---|
| 4,432,420 | A * | 2/1984 | Gregory | E21B 19/09 166/355 |
| 7,900,381 | B2 * | 3/2011 | Clymans | F28F 1/325 114/295 |
| 2009/0126237 | A1 * | 5/2009 | Clymans | E02F 9/062 37/317 |
| 2015/0345107 | A1 * | 12/2015 | Zwanenburg | E02F 3/9231 37/309 |
| 2017/0089037 | A1 * | 3/2017 | Knol | B63H 19/08 |

FOREIGN PATENT DOCUMENTS

| | | | | |
|---|---|---|---|---|
| NL | 1011753 | C1 | 10/2000 | |
| WO | 2006130934 | A2 | 12/2006 | |
| WO | WO-2013157944 | A1 * | 10/2013 | E02F 3/8841 |

* cited by examiner

SPUD CARRIER SYSTEM

BACKGROUND

The present invention relates to a spud system for a dredging vessel with a longitudinal direction, which spud system has wire suspension system coupled with a spud carrier for resiliently forcing said spud in a vertical stance.

In general a cutter suction dredgers is fitted with a spud carrier that allows the dredger to be pushed forward when the working spud mounted in the spud carrier has penetrated into the bottom.

For long times dredgers have been equipped with a wire suspension system to keep the spud carrier upright. This way torsion between spud carrier and dredging vessel is avoided and cutter production can be enhanced.

In circumstances where large external forces are exerted on the dredger due to sea currents, waves, swell or other causes, overloading of the spud and/or the spud carrier cylinder, which drives the spud carrier, must be prevented by allowing the spud carrier to give way to the load from a neutral position. The neutral position refers to the carrier and the spud wherein the spud takes a vertical stance.

However in view of production capacity of the cutter suction dredger, it is important that the neutral position of the spud carrier is a) well defined and that, b) after removal of the overload condition, the spud carrier quickly returns to that neutral position.

It is known for spud carriers that are held in vertical position by means of a wire system, the overload protection can be realized by allowing at least one of the sheaves to move. As a result the spud carrier will rotate and give way to the overload. Simply connecting a gas spring (accumulator) to this wire system prevents overloading to occur but has as a consequence that there is no well-defined fixed position of the spud before and after overload. Such a spud carrier system is known from WO2006130934 wherein an apparatus is disclosed for accommodating a substantially vertical spud of a dredging vessel with a longitudinal direction, comprising a spud carriage which is mounted for limited rotation around a horizontal transverse axis, wherein at least a first and a second spring means is arranged under bias between vessel and spud in the longitudinal direction for the purpose of absorbing a moment on the spud carriage, which first and second spring means compensate each other in the non-loaded situation of the spud; and—at least one spring means is provided with a spring force limiting means for limiting the tension in said spring element from a determined maximum moment on the spud carriage.

SUMMARY OF THE INVENTION

The invention aims to provide a spud system wherein the neutral position of the carrier is better defined and the return to said neutral position is facilitated.

Yet another object of the invention is to provide a spud system wherein a problem associated with known spud system is at least partly solved.

Yet a further object of the invention is to provide an alternative spud system.

According to a first aspect of the invention this is realized with a spud system for a dredging vessel with a longitudinal direction, which spud system comprises;

a spud carrier for mounting a spud therein in a vertical stance and which spud carrier is mounted for limited rotation around a horizontal transverse axis and is moveable with respect to the dredging vessel in a longitudinal direction for advancing the dredging vessel, a spud carrier drive system coupled with the dredging vessel and the spud carrier for driving the spud carrier with respect to the dredging vessel, a wire suspension system coupled with the spud carrier for resiliently forcing said spud in a vertical stance, the wire suspension system comprising at least a first and second wire, each of the first and second wire extending on both sides of the spud carrier and having an aft end and a fore end coupled with the dredging vessel, a spud centring system operationally coupled with the spud carrier through the wire suspension system for maintaining a vertical stance of said spud which is mounted in the spud carrier, wherein the spud centring system comprises a centring cylinder having a central rod which is forced towards a central position by prestressing means exerting a centring force on the central rod, and wherein the first wire and the second wire are coupled with the central rod in such a way that the central rod is driven by a difference in tension between the first and second wire and the spud is allowed to cant when the difference in tension exceeds the centring force.

Coupling the first and second wire through the central rod of a centring cylinder facilitates to define a central position for the spud and allows a quick return to said central position after removal of the overload condition. In addition, no pump capacity is required for the spud to return to its central position. Instead, the return of the spud to its neutral position is a passive action. Also, driving the central rod by a difference in tension between the first and second wire enables to adjust the tension in the wires and the centring force independently.

In an embodiment of the spud system, the first wire is in fluid connection with the one end of the central rod. Such a fluid connection may be realised through hydraulic cylinders coupled with a fluid conduit.

In an embodiment of the spud system, the second wire is in fluid connection with the opposite end of the central rod.

In an embodiment of the spud system the wire tensioning system comprises a first wire tensioning cylinder coupled with the first wire for tensioning the first wire, and the first wire is in fluid connection with one end of the central rod through the first wire tensioning cylinder.

In an embodiment of the spud system, the wire tensioning system comprises a second wire tensioning cylinder coupled with the second wire for tensioning the second wire, and the second wire is in fluid connection with an opposite end of the central rod through the second wire tensioning cylinder.

In an embodiment of the spud system the one end and the opposite end of the central rod each end in a respective first centring fluid chamber and second centring fluid chamber, the first wire tensioning cylinder is in fluid connection with the first centring fluid chamber, and the second wire tensioning cylinder is in fluid connection with the second centring fluid chamber. A respective wire is in fluid connection with the central rod through the respective wire tensioning cylinder and the respective centring fluid chamber. A force on the spud influences the pressure in the first centring fluid chamber and second centring fluid chamber.

In an embodiment of the spud system, the spud system comprises a wire tensioning device coupled with the first and second wire for tensioning these, wherein the tensioning device comprises a hydraulic system coupled with the first wire tensioning cylinder and the second wire tensioning cylinder for pressurizing these in an equal way such that the first and second wire are equally stretched. The wire tensioning device ensures that no slack wires situation occurs during operation. The wire tension device in conjunction with the actual load on the spud determines the pressure in the in the first centring fluid chamber and second centring fluid chamber.

In an embodiment of the spud system, the tensioning device comprises a piston, a piston chamber, a source of pressure coupled with the piston chamber for pressurizing the piston chamber, a piston rod extending in a first fluid chamber fluidly coupled with the first wire tensioning cylinder and a second fluid chamber fluidly coupled with the second wire tensioning cylinder, wherein the tensioning device is configured such that an equal amount of fluid is displaced from or into the first and second fluid chamber upon moving the piston rod such that the first and second wire are equally stretched.

In an embodiment of the spud system, the prestressing means comprise a pair of opposite pressurized fluid chambers, the central rod is provided with a central flange arranged such that the opposite pressurized fluid chambers exert the centring force on the central rod. Preferably, the pair of opposite pressurized fluid chambers are in fluid connection with a common source of pressure. Preferably, the common source of pressure comprises an accumulator with an adjustable gas pressure in order to be able to adjust the centring force. It is also conceivable that the accumulator has an adjustable force vs displacement characteristic.

In an embodiment of the spud system, the central rod is provided with a free piston and the centring force is exerted through said free piston.

In an embodiment of the spud system, the central rod is provided with a pair of opposite free pistons arranged at opposite sides of the central flange and the centring force is exerted through said pair of pistons.

The invention further relates to a dredger comprising the spud system according to the invention.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to the following drawings wherein shown in.

DETAILED DESCRIPTION OF EMBODIMENTS

Figure 1:
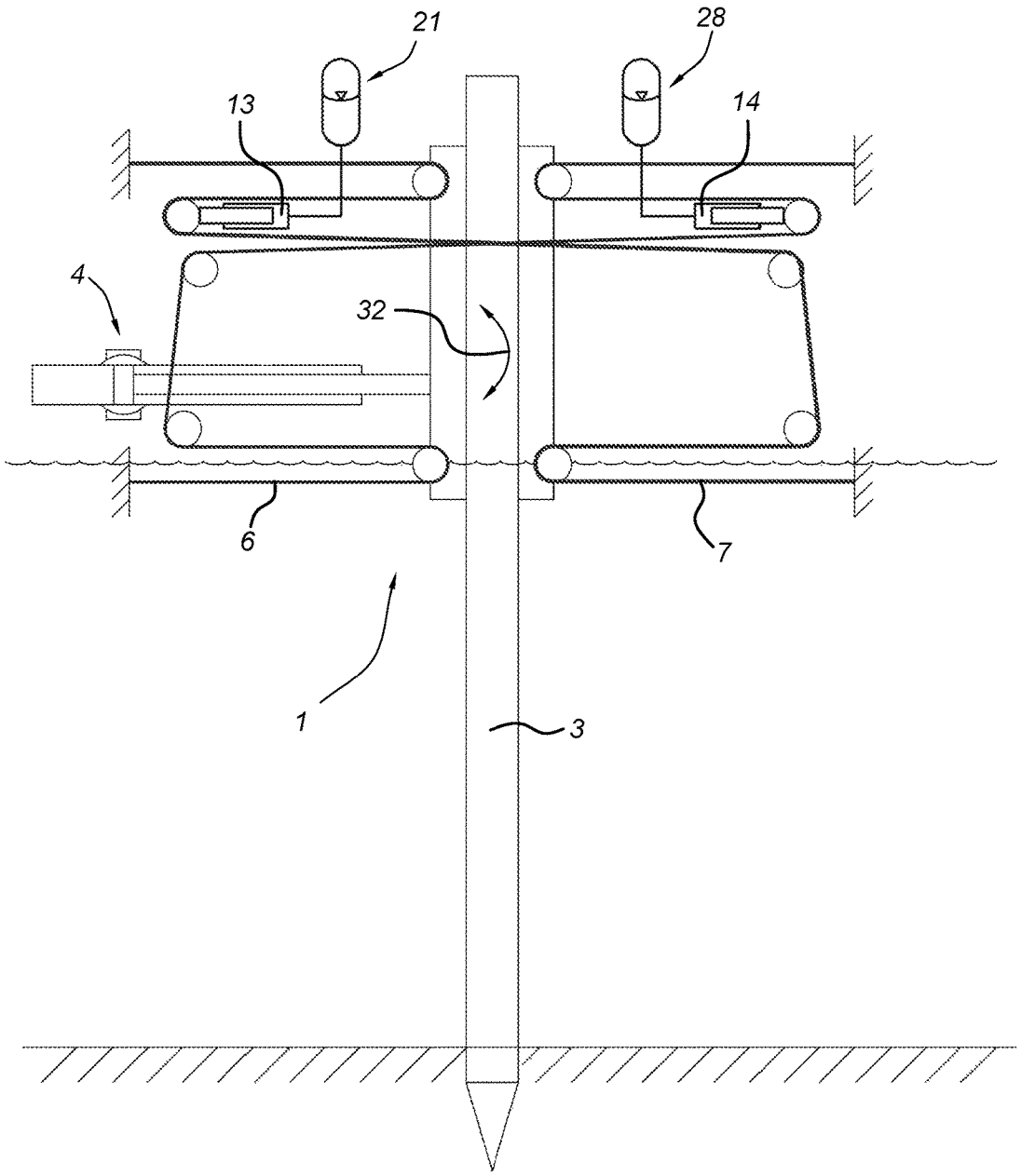
FIG. 1 in schematic side view a prior art spud system.

In FIG. 1 shows a prior art spud system 1. The spud system 1 comprises a spud carrier 2 for mounting a spud 3 therein in a vertical stance. The spud carrier 2 is mounted for limited rotation α around a virtual horizontal transverse axis 32 which limited rotation allows to accommodate overload conditions. The spud system 1 comprises a spud carrier drive system 4 coupled with the dredging vessel and the spud carrier 2 for driving the spud carrier 2. The spud system 1 has a first 6 and second 7 wire. Each of the first 6 and second 7 wire extend on both sides of the spud carrier 2 and is coupled with the dredging vessel with both cable ends. The spud system 1 has a first wire tensioning cylinder 14 coupled with the first wire 6 for tensioning the first wire. The spud system 1 has a second wire tensioning cylinder 13 coupled with the second wire 7 for tensioning the second wire. The first wire tensioning cylinder 14 is coupled with an accumulator 21 and the second wire tensioning cylinder 13 is coupled with an accumulator 28 for pressurizing the cylinder.

Figure 2:
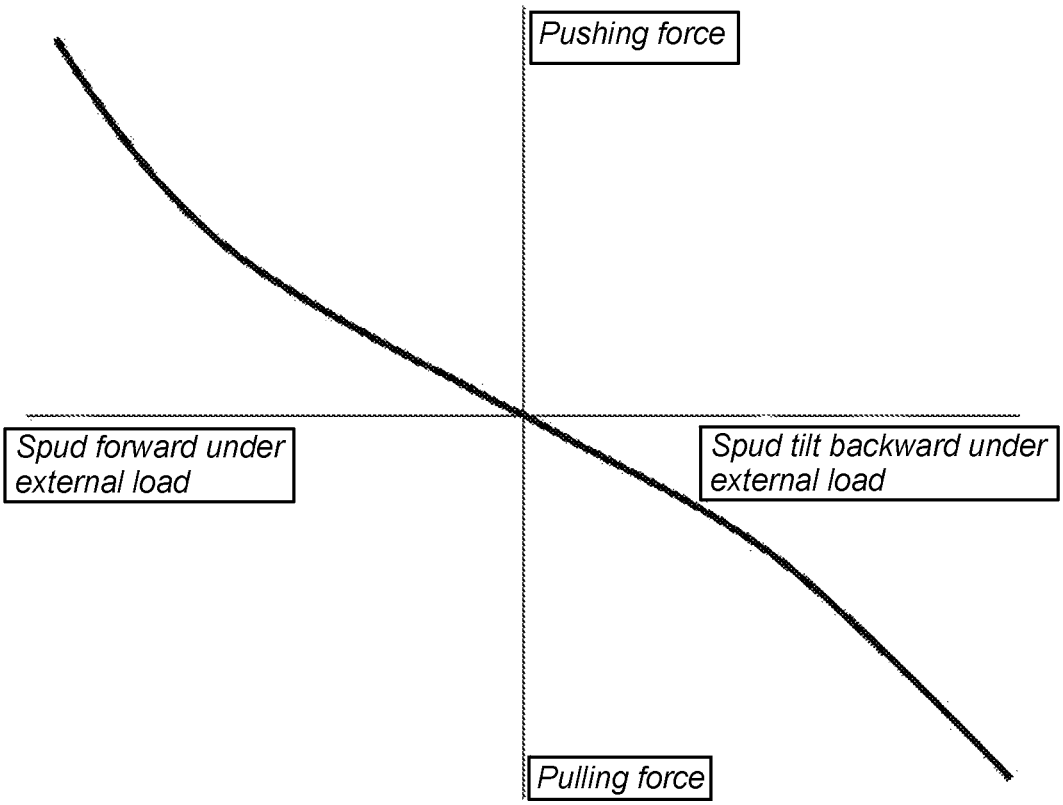
FIG. 2 a graph of the relation between spud force and spud angle for a prior art spud system of FIG. 1.

Now turning to FIG. 2 wherein is shown a graph of the relation between spud force versus spud angle for the prior art spud system of FIG. 1. The prior art spud system 1 suffers in that the position of the spud is not well defined and the forces on the spud are not adequately limited.

Figure 3:
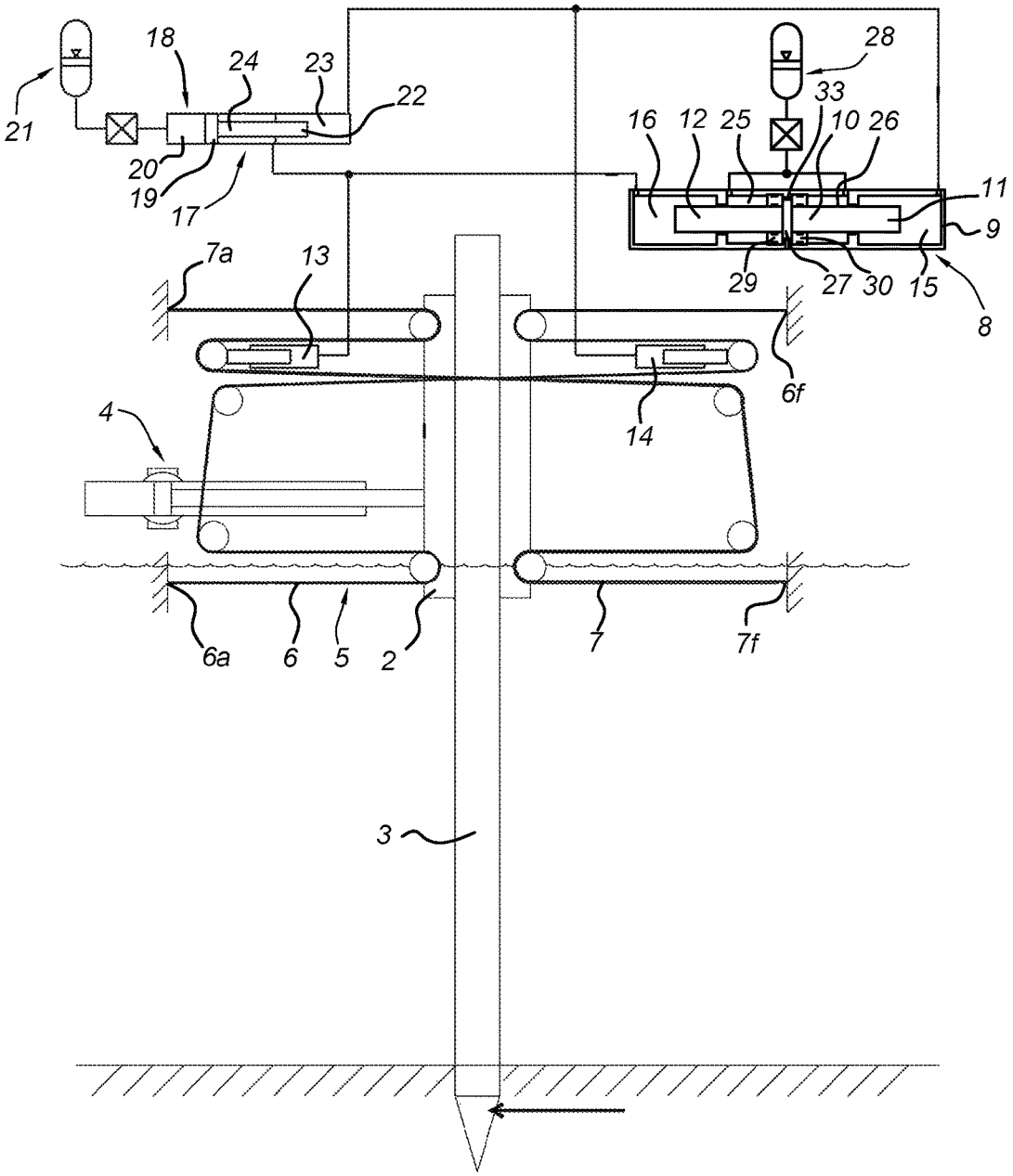
FIG. 3 an embodiment of a spud system according to the invention.

In FIG. 3 shows an embodiment of a spud system 1 according to the invention. The spud system 1 comprises a spud carrier 2 for mounting a spud 3 therein in a vertical stance. The spud carrier 2 is mounted for limited rotation α around a horizontal transverse axis 32 which limited rotation allows to accommodate overload conditions. The "mounted for limited rotation" refers to the assembly of the spud 3 and the spud carrier, it is however conceivable that the spud 3 itself is mounted in the spud carrier 2 for limited rotation while the spud carrier 2 itself may not rotate.

The spud carrier 2 is moveable with respect to the dredging vessel (not shown) in a longitudinal direction for advancing the dredging vessel. Therefore, the spud system 1 comprises a spud carrier drive system 4 coupled with the dredging vessel and the spud carrier 2 for driving the spud carrier 2 with respect to the dredging vessel.

The spud system 1 comprises a wire suspension system 5 coupled with the spud carrier 2. The wire suspension system 5 is configured for resiliently forcing said spud 3 in a vertical stance, which vertical stance is also referred to with "neutral position". The wire suspension system 5 comprising at least a first 6 and second 7 wire. Each of the first 6 and second 7 wire extends on both sides of the spud carrier 2 and have an aft end 6*a*, 7*a* and a fore end 6*f*, 7*f* coupled with the dredging vessel. The first 6 and second 7 wire are coupled with the spud carrier 2 through a number of sheaves or cable pulleys in a manner known per se and not further described. Different numbers of sheaves are conceivable as long as the wires 6, 7 are capable to force the spud in the vertical stance as shown in FIG. 3.

The wire suspension system 5 is configured such that a load on the spud 3 leads to a difference in tension between the first wire 6 and the second wire 7.

The spud system 1 comprises a spud centring system 8 for maintaining a vertical stance of said spud 3 which is mounted in the spud carrier 2. The spud centring system 8 is operationally coupled with the spud carrier 2 through the wire suspension system 5. The spud centring system 8 comprises a centring cylinder 9. A centring cylinder is known per se.

The centring cylinder 9 has a central rod 10 which is forced towards a central position as shown in FIG. 3. The central rod 10 is forced towards its central position by prestressing means 25-30 exerting a centring force F on the central rod 10.

The prestressing means comprise a pair of opposite pressurized fluid chambers 25, 26. The central rod is provided with a central flange 27. The flange 27 is arranged such that the opposite pressurized fluid chambers 25, 26 exert the centring force on the central rod 10. The central rod 10 is provided with a pair of opposite free pistons 29, 30. These pistons 29, 30 are arranged at opposite sides of the central flange 27. The centring force is exerted through said pair of pistons 29, 30. The centring force drives the pistons towards the flange 27. The centring cylinder 9 is provided with a central stop 33 for defining a central position of the central rod 10. The stop 33 may be circumferential.

Figure 4:
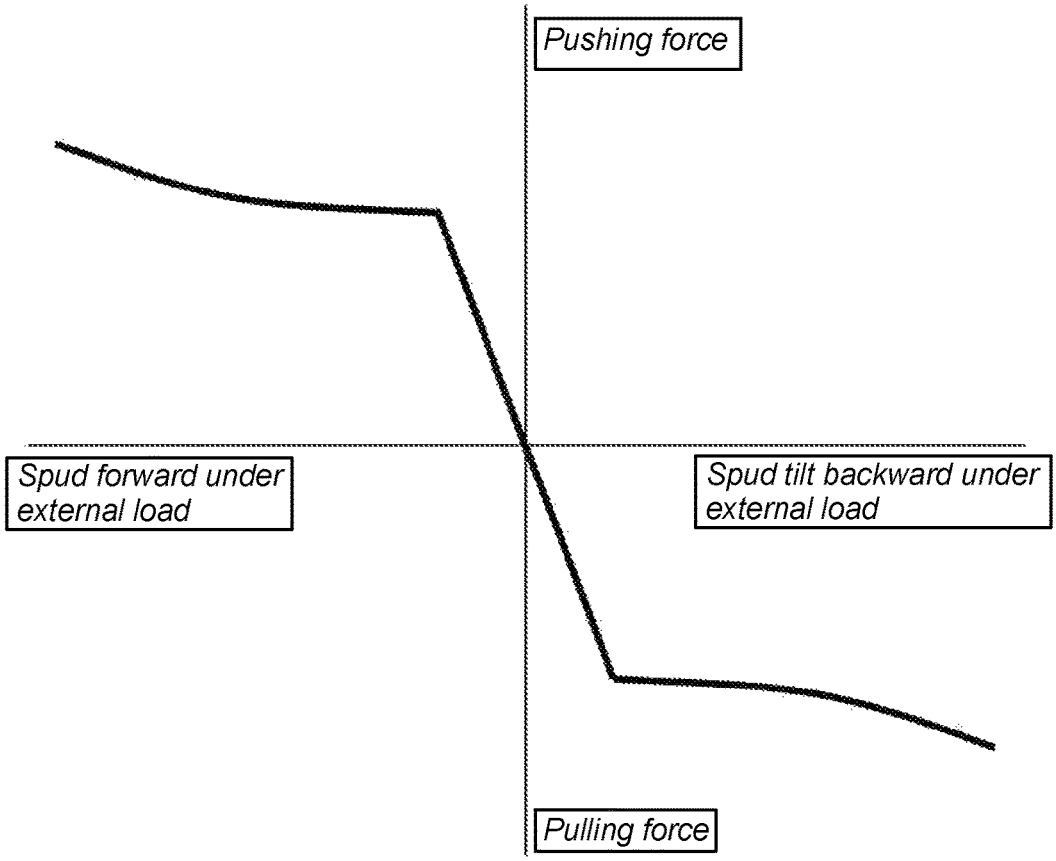
FIG. 4 a graph of the relation between spud force and spud angle for the spud system of FIG. 3.
Figure 5:
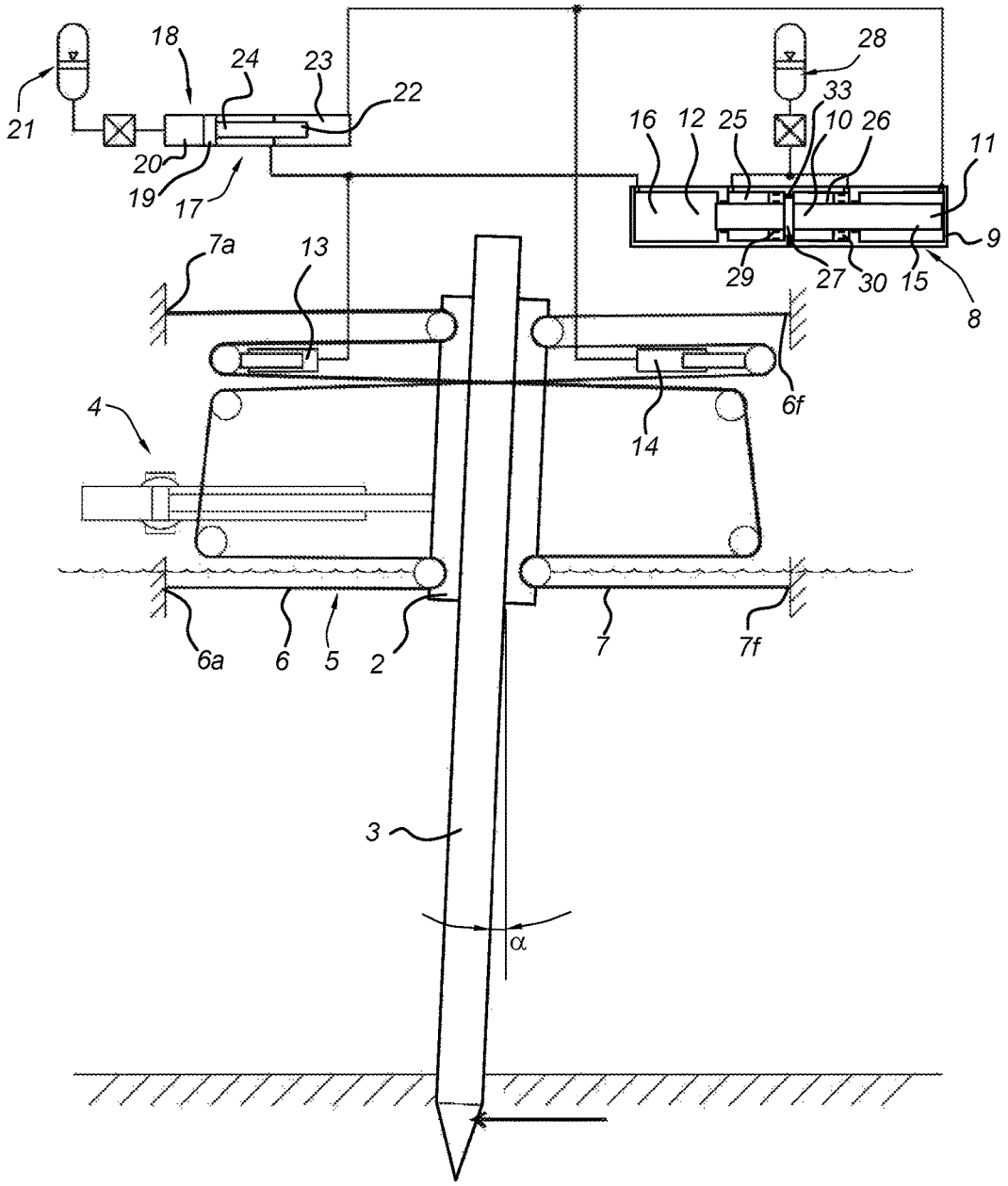
FIG. 5 spud system of FIG. 3 in overload condition.

During operations, the spud system functions as follows. The wire tensioning device 17 tensions the first 6 and second 7 wire to prevent a slack wire. The centring force drives the pistons 29, 30 towards the stop 33. In normal conditions, the pistons 29, 30 abut against, in other words contact, the stop 33 on opposite sides of the stop 33, resulting in a space for receiving the flange 27. In normal conditions, the flange 27 is locked between the opposite pistons 29, 30. A load on the spud causes the spud 3 to tilt over an angle $\alpha$ and causes a difference in tension between the first 6 and second 7 wire. Now when the difference in tension between the first wire 6 and the second wire 7 exceeds the centring force exerted on the free pistons 29, 30, the central rod 10 will move away from its central position, as shown in FIG. 5. When moving out of its central position, the flange 27 abuts one of the pistons 29, 30 and moves therewith in unity. The movement of the central rod 10 cause displacement from fluid in the first centring fluid chamber 15 and the second centring fluid chamber 16. Through the fluid coupling of these chambers 15, 16 with the wire tensioning cylinders 13, 14 the wires 6, 7 are paid out or hauled in such that the spud 3 may tilt and loads between the spud and vessel are decreased as shown in FIG. 4.

Here, the pair of opposite pressurized fluid chambers 25, 26 are in fluid connection with a common source of pressure, the accumulator 28. Expelled liquid from one of the opposite pressurized fluid chambers 25, 26 will be accommodated in the accumulator 28. The pressure in the accumulator can be adjusted by adjustment means (not shown) to adjust the centring force.

As mentioned, the spud centring system 8 is operationally coupled with the spud carrier 2 through the wire suspension system 5. Therefore, the first wire 6 of the wire suspension system 5 is coupled with one end 11 of the central rod 10. The second wire 7 of the wire suspension system 5 is coupled with an opposite end 12 of the central rod 10.

The spud system 1 comprise comprises a wire tensioning device 17 coupled with the wire suspension system 5, more precisely, the first 6 and second 7 wire thereof for tensioning these wires 6, 7. This wire tensioning device 17 is important to prevent slack wires which may come off from pulleys and sheave or prevent the wire suspension system 5 from functioning otherwise. With respect to the wire suspension system 5, reference is made to FIG. 1 and its description. The wire tensioning device 17 comprises a hydraulic system 18 coupled with the first wire tensioning cylinder and the second wire tensioning cylinder for pressurizing these both in an equal way such that the first and second wire are equally stretched. Therefore, the tensioning device 17 comprises a first fluid chamber 23 fluidly coupled with the first wire tensioning cylinder 14 and a second fluid chamber 24 fluidly coupled with the second wire tensioning cylinder 13. The wire tensioning device 17 is configured such that an equal amount of fluid is displaced from or into the first and second fluid chamber upon moving a piston rod 22 such that the first and second wire are equally stretched.

For displacing fluid, the tensioning device comprises a piston 19, the piston rod 22, a piston chamber 20, and a source of pressure 21 coupled with the piston chamber for pressurizing the piston chamber. The piston rod 22 extends in the first fluid chamber 23 and the second fluid chamber 24, wherein the tensioning device is configured such that an equal amount of fluid is displaced from or into the first and second fluid chamber upon moving the piston rod 22 such that the first and second wire are equally stretched.

The central rod 10 is driven by a difference in tension between the first 6 and second 7 wire. When the difference in tension exceeds the centring force F, the spud 3 is allowed to cant to protect the spud. This can be seen in FIG. 4 in the first and third quadrant wherein the almost horizontal section makes clear that the force on the spud 3 is limited.

Figure 6:
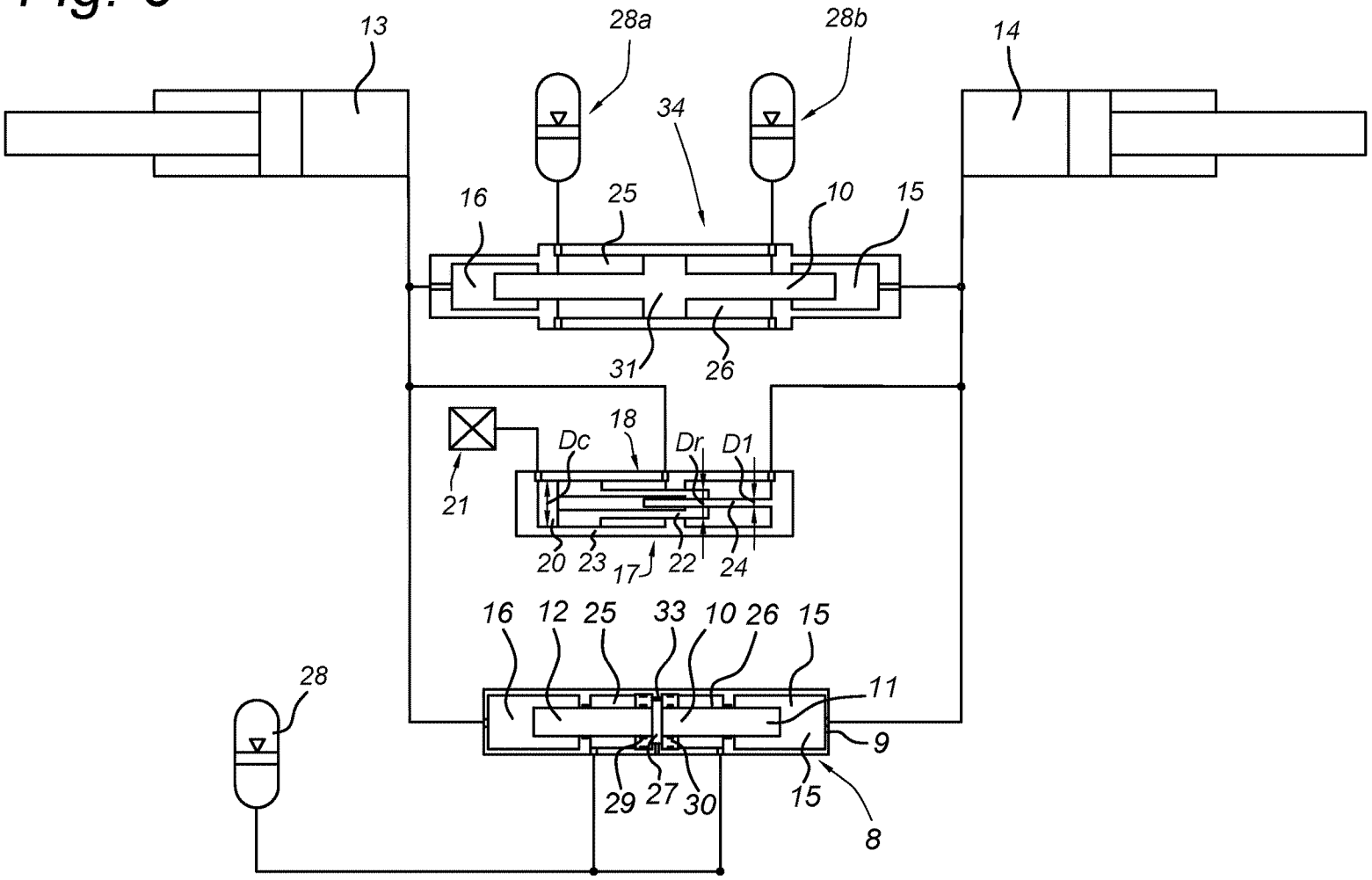
FIG. 6 a further embodiment of a spud system according to the invention.

FIG. 6 shows a part of an embodiment of the spud system according to the invention. A different wire tensioning device 17 is used wherein the rod 22 is hollow. The Diameters Dc, Dr and Di are chosen such an equal amount of fluid is displaced from or into the first 23 and second 24 fluid chamber upon moving the piston rod 22 such that the first and second wire are equally stretched. In addition, an optional spring device 34 is shown in parallel with the centring system 8. The configuration of the spring device 34 is similar to that of the centring system 8 however the stop 33 and the free pistons 29, 30 are not provided, and also the flange is replace by a piston 31. The function of the spring device 34 is to adjust the stiffness of the wire suspension system. In FIG. 4, this lower stiffness results in a less steep middle section of the graph.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A spud system for a dredging vessel with a longitudinal direction, which spud system comprises;

a spud carrier for mounting a spud therein in a vertical stance and which spud carrier is mounted for limited rotation around a horizontal transverse axis and is moveable with respect to the dredging vessel in a longitudinal direction for advancing the dredging vessel, a spud carrier drive system coupled with the dredging vessel and the spud carrier for driving the spud carrier with respect to the dredging vessel, a wire suspension system coupled with the spud carrier for resiliently forcing said spud in a vertical stance, the wire suspension system comprising at least a first and second wire, each of the first and second wire extending on both sides of the spud carrier and having an aft end and a fore end coupled with the dredging vessel, a spud centring system operationally coupled with the spud carrier through the wire suspension system for maintaining a vertical stance of said spud which is mounted in the spud carrier, wherein the spud centring system comprises a centring cylinder having a central rod which is forced towards a central position by prestressing means exerting a centring force on the central rod, and wherein the first wire and the second wire are coupled with the central rod in such a way that the central rod is driven by a difference in tension between the first and second wire, and the spud is allowed to cant when the difference in tension exceeds the centring force.

2. A spud system according to claim 1, wherein the first wire is in fluid connection with the one end of the central rod.

3. A spud system according to claim 1, wherein the second wire is in fluid connection with the opposite end of the central rod.

4. A spud system according to claim 2, wherein the wire tensioning system comprises a first wire tensioning cylinder coupled with the first wire for tensioning the first wire, and the first wire is in fluid connection with one end of the central rod through the first wire tensioning cylinder.

5. A spud system according to claim 3, wherein the wire tensioning system comprises a second wire tensioning cylinder coupled with the second wire for tensioning the second wire, and the second wire is in fluid connection with an opposite end of the central rod through the second wire tensioning cylinder.

6. A spud system according to claim 1, wherein the one end and the opposite end of the central rod each end in a respective first centring fluid chamber and second centring fluid chamber, the first wire tensioning cylinder is in fluid connection with the first centring fluid chamber, and the second wire tensioning cylinder is in fluid connection with the second centring fluid chamber.

7. A spud system according to claim 1, comprising a wire tensioning device coupled with the first and second wire for tensioning these, wherein the tensioning device comprises a hydraulic system coupled with the first wire tensioning cylinder and the second wire tensioning cylinder for pressurizing these in an equal way such that the first and second wire are equally stretched.

8. A spud system according to claim 7, wherein the tensioning device comprises a piston, a piston chamber, a source of pressure coupled with the piston chamber for pressurizing the piston chamber, a piston rod extending in a first fluid chamber fluidly coupled with the first wire tensioning cylinder and a second fluid chamber fluidly coupled with the second wire tensioning cylinder, wherein the tensioning device is configured such that an equal amount of fluid is displaced from or into the first and second fluid chamber upon moving the piston rod such that the first and second wire are equally stretched.

9. A spud system according to claim 1, wherein the prestressing means comprise a pair of opposite pressurized fluid chambers, the central rod is provided with a central flange arranged such that the opposite pressurized fluid chambers exert the centring force on the central rod.

10. A spud system according to claim 9, wherein the pair of opposite pressurized fluid chambers are in fluid connection with a common source of pressure.

11. A spud system according to claim 10, wherein the common source of pressure comprises an accumulator with an adjustable gas pressure in order to be able to adjust the centring force.

12. A spud system according to claim 1, wherein the central rod is provided with a free piston and the centring force is exerted through said free piston.

13. A spud system according to claim 12, wherein the central rod is provided with a pair of opposite free pistons arranged at opposite sides of the central flange and the centring force is exerted through said pair of pistons.

14. A dredger comprising the spud system of claim 1.

* * * * *